United States Patent [19]

Asano et al.

[11] 4,237,829

[45] Dec. 9, 1980

[54] VARIABLE REFERENCE MIXTURE CONTROL WITH CURRENT SUPPLIED EXHAUST GAS SENSOR

[75] Inventors: Masaharu Asano, Yokosuka; Shigeo Aono, Seki; Haruto Tanaka, Yokohama, all of Japan

[73] Assignee: Nissan Motor Company, Limited, Yokohama, Japan

[21] Appl. No.: 25,189

[22] Filed: Mar. 29, 1979

[30] Foreign Application Priority Data

Apr. 3, 1978 [JP] Japan ..... 53-38065

[51] Int. Cl.[3] ..... F02D 3/04

[52] U.S. Cl. ..... 123/489; 123/440

[58] Field of Search ..... 123/119 EC, 32 EE; 60/276, 285

[56] References Cited

U.S. PATENT DOCUMENTS

| | | | |
|---|---|---|---|
| 4,153,023 | 5/1979 | Asano et al. | 123/119 EC |
| 4,156,413 | 5/1979 | Taplin | 123/119 EC |
| 4,167,925 | 9/1979 | Hosaka et al. | 123/119 EC |
| 4,169,440 | 10/1979 | Taplin et al. | 123/119 EC |

*Primary Examiner*—Tony M. Argenbright

*Attorney, Agent, or Firm*—Lowe, King, Price & Becker

[57] ABSTRACT

Mixture ratio control for internal combustion engines supplies a constant current into an exhaust gas sensor to develop a voltage of a substantial magnitude in proportion to the initial high value of the gas sensor internal impedance during low temperature conditions. The voltage so developed decreases as a function of time corresponding to the decrease of the internal impedance with temperature. A voltage detector is provided to trigger the control system to operate in a closed loop mode when the gas sensor voltage is reduced to a level below a first threshold level. Responsive to the output of the voltage detector the supplied current is momentarily interrupted to allow the gas sensor voltage to drop rapidly to a level which is higher or lower than a second threshold level depending on the concentration of the sensed gas in the exhaust system. A second detector senses this voltage drop relative to the second threshold to determine whether the gas sensor output represents rich or lean condition. The reference point of the closed loop is raised or lowered in response to the output of the second detector and further decreased as a function of time such that the reference point lies within the range between maximum and minimum peak values of the gas sensor output signal.

8 Claims, 4 Drawing Figures

X
Y
VHH
50
VH
VL
Y'
0
T
TIME
COMP 14
0
COMP 20
24-1
MONO 24
DELAY 26
32-1
MONO 32
COMP 28
1
0
AND 36
1
0
AND 38
1
0
t'2
t2
t1
t3
t4
t5

VARIABLE REFERENCE MIXTURE CONTROL WITH CURRENT SUPPLIED EXHAUST GAS SENSOR

BACKGROUND OF THE INVENTION

The present invention relates to fuel control system for internal combustion engines, and in particular to a method and system for controlling the air-fuel ratio of mixture supplied to the engine in a closed loop operational mode during warm-up periods to thereby reduce the harmful components of the emission during such periods.

In conventional closed loop fuel control systems the air-fuel ratio of mixture supplied to the engine is corrected in response to a feedback signal which represents the deviation of the concentration of oxygen in the exhaust emissions detected by a zirconia dioxide oxygen sensor from a reference point which usually corresponds to the stoichiometric air-fuel ratio. The internal impedance of the oxygen however exhibits a considerably high impedance value when temperature within the exhaust system is low during warm-up periods. This impedance decreases as a function of temperature to a low or normally operating value when the engine has warmed up. Therefore, the signal provided by the gas sensor having a high internal impedance value cannot be used as a valid feedback signal and the conventional practice is to suspend the closed loop mode until the engine has warmed up, tending to produce a considerable amount of noxious emissions during warm-up periods.

SUMMARY OF THE INVENTION

According, it is an object of the invention to allow closed loop fuel control operation to commence during warm-up periods to decrease the noxious emissions.

According to the invention, this object is achieved by supplying a substantially constant current to the gas sensor to allow it to develop a corresponding voltage across its high impedance during warm-up periods. Since the internal impedance decreases as a function of temperature, the voltage so developed decreases accordingly. However, the voltage has different value depending on the initial concentration of oxygen gas within the emissions. If the concentration represents a rich mixture condition, a higher voltage output will be delivered from the gas sensor than that generated during the lean mixture condition.

A first voltage detector or comparator is provided to detect when the voltage delivered from the gas sensor reuduces to a level below a first threshold level to briefly interrupt the current to the gas sensor and to allow the system to commence closed loop operation. In response to this current suspension, the voltage output from the gas sensor rapidly reduces to a level which is higher or lower than a second threshold level depending on the initial voltage level of the gas sensor; the second threshold level being lower than the first threshold level and corresponding to the constant reference point of the closed loop operation which is effected when the gas sensor is operating above its normally operating temperature. If the initial gas sensor output represents a rich mixture the voltage will reduce to a level higher than the second threshold and conversely, under lean initial condition, the voltage will reduce to a level lower than the second threshold.

A second detector is provided to sense the extent of the voltage drop with respect to the second threshold to detect the initial condition of the gas sensor. The reference point of the system is initially set at a point corresponding to the first threshold level with which the system commences feedback operation and varied in different directions depending on the output from the second threshold detector. The varied reference point is then allowed to decrease as a function of time until it reaches the second threshold level.

BRIEF DESCRIPTION OF THE DRAWINGS

The invention will be further described by way of example with reference to the accompanying drawings, in which.

DETAILED DESCRIPTION

Figure 1:
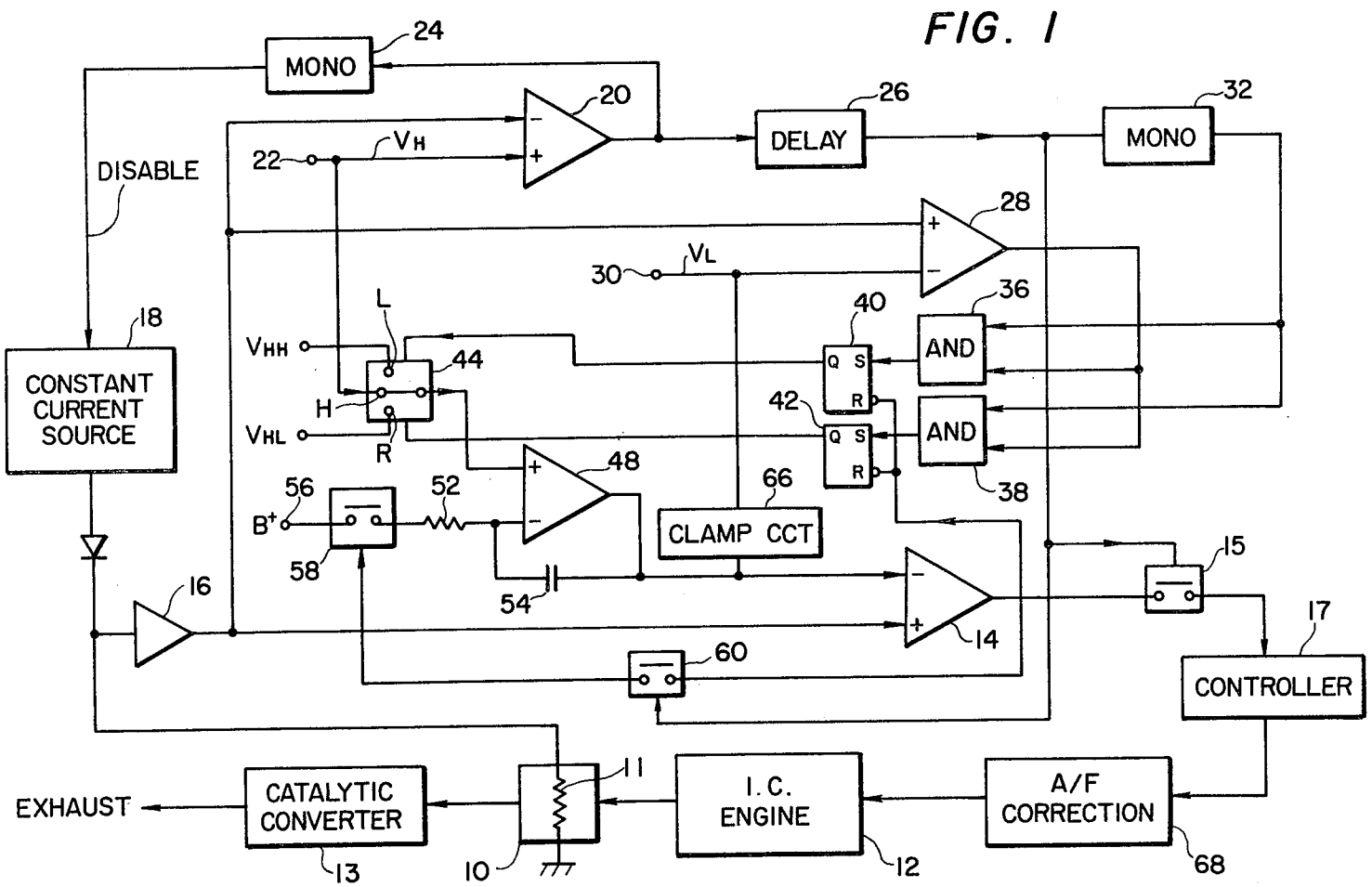
FIG. 1 is a schematic block diagram of an embodiment of the invention.

In FIG. 1, an air-fuel mixture control system embodying the invention comprises an exhaust gas sensor 10 provided in the exhaust conduit of an internal combustion engine 12 upstream from a catalytic converter 13 to generate a gas sensor output signal for application to the noninverting input of a comparator 14 through a buffer amplifier 16. The gas sensor 10 is of a zirconia dioxide type which detects the concentration of oxygen gas in the exhaust emissions and generates a corresponding electrical signal. This oxygen gas sensor has a very large internal impedance when ambient temperature is very low and has a small internal impedance when the temperature is high. Therefore, gas sensor signals are usually valid only when the gas sensor is above its normally operating temperature, and closed loop fuel control is conventionally effected in response to such valid gas sensor signals. The comparator 14 compares the gas sensor output signal with a reference voltage supplied to its inverting input to develop a signal representative of the deviation of the concentration of the sensed exhaust composition from the reference point which is usually set at a point at or near the stoichiometric air-fuel ratio. The deviation signal from the comparator 14 is coupled by a normally open switch 15 to a proportional/integral controller 17 and thence to an air-fuel correction means 68 such as electronic carburetor or fuel injection control unit. In the initial period of engine start, the switch 15 remains off, so that the mixture is controlled in an open loop mode.

A constant current source 18 is provided to supply electric current of a substantially constant magnitude into the gas sensor 10 developing a voltage of a substantial magnitude across the internal impedance 11 of the gas sensor 10, since the gas sensor internal impedance is considerably high during warm-up periods.

Figure 2:
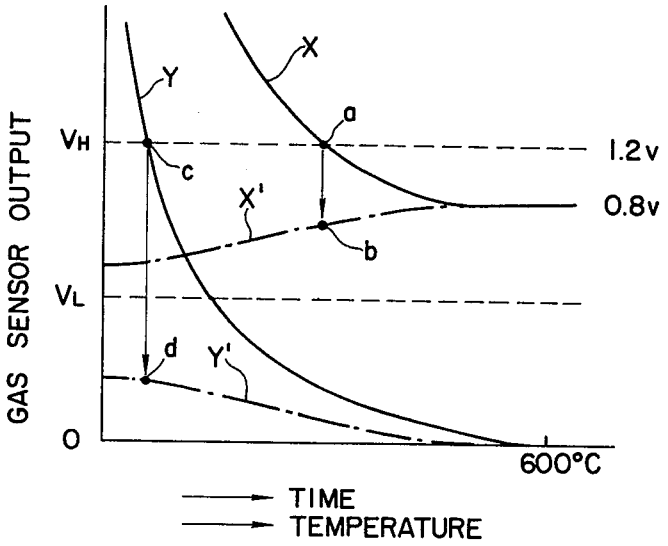
FIG. 2 is a graphic illustration of the operating characteristics of an exhaust gas sensor into which a constant current is injected.

Since the gas sensor internal impedance reduces as a function of temperature, the voltage so developed also decreases correspondingly. Therefore, as engine warm-up operation progresses the gas sensor voltage decreases with time. The voltage developed in response to the current also depends on the concentration of oxygen gas within the exhaust system, as a results it adopts one of curves X and Y illustrated in FIG. 2 depending on the sensed concentration representing rich or lean mixture condition, respectively. Curves X and Y are also representative of a plot of maximum and minimum peak values of the gas sensor 10. During the time prior to closed loop operation, the gas sensor output tends to remain on one of the plotted curves depending on its initial condition, and during the closed loop operation the gas sensor output fluctuates between curves X and Y depending on the relative value of the gas sensor output to the reference point of closed loop control system. With no injection current, the gas sensor exhibits an output of low voltage level as indicated by curve X' or Y' corresponding to rich or lean mixture condition, respectively.

The voltage developed by the gas sensor 10 is applied to the inverting input of a comparator 20 for comparison with a fixed threshold voltage $V_H$ (=1.2 volts) supplied from terminal 22 to provide a high voltage output to a monostable multivibrator 24 and concurrently to a delay circuit 26 when the gas sensor output voltage reduces to a level lower than the threshold $V_H$. The monostable 24 generates an inhibit pulse for disabling the constant current source for a short interval. This results in a rapid reduction of the gas sensor output to the level of one of the curves X' and Y' depending on the previous condition of the gas sensor 10. For example, if the gas sensor output adopts curve X and crosses the threshold $V_H$ at point a in FIG. 2, the voltage will reduce to a point b on curve X' which lies above a second or lower threshold level $V_L$ which corresponds to the stoichiometric point of the mixture ratio, and if it crosses $V_H$ at point c the voltage will reduce to a point d on curve Y' which lies below the lower threshold $V_L$. Therefore, it is appreciated that whether the gas sensor indication is rich or lean can be determined by sensing the reduced voltage level relative to threshold $V_L$. This is accomplished by a comparator 28 which receives the amplified gas sensor output on its noninverting input for comparison with a reference voltage corresponding to the threshold value $V_L$ supplied from terminal 30. This voltage reduction manifests itself in a delayed interval from the time of the disablement. A delay circuit 26 is connected to the output of the comparator 20 to introduce a delay to trigger a monostable multivibrator 32 to allow it to generate a sampling or enabling pulse for sampling AND gates 36 and 38. AND gate 36 has an inverted input connected to the output of the comparator 28 and AND gate 38 has a noninverted input connected to the output of this comparator. Therefore, AND gate 36 produces a logic "1" when the comparator 28 output is low in the presence of the sampling pulse, and AND gate 38 produces a logic "1" when the comparator 28 output is high in the presence of said sampling pulse. Flip-flop circuits 40 and 42 are provided to receive output signals from sampling gates 36 and 38, respectively. These flip-flops are initially reset in response to a low voltage output from the comparator 14.

Figure 3:
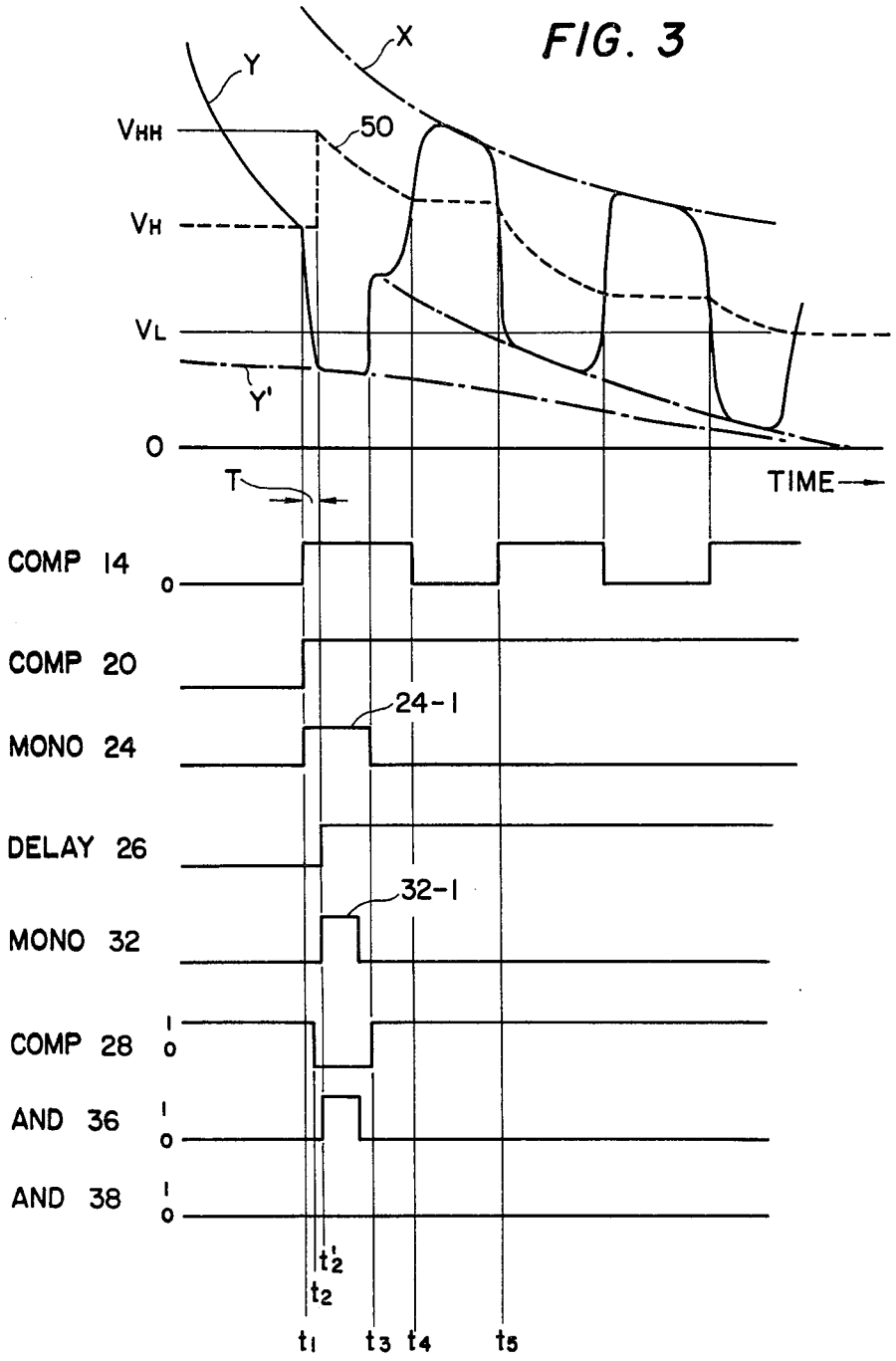
FIG. 3 is a waveform diagram useful for describing the operation of the embodiment when the gas sensor's initial condition representents a lean mixture.

Assuming that the initial output condition of the gas sensor 10 indicates a lean condition adopting curve Y as illustrated in FIG. 3. The comparator 20 will be switched to a high output state in response to the voltage on curve Y crossing the threshold level $V_H$ at time $t_1$ causing monostable 24 to produce a pulse 24-1 which is applied to the injection current source 18. During this pulse period, the injection current is inhibited to cause the voltage across the internal impedance 11 of the gas sensor 10 to drop sharply to a level corresponding to the curve Y' after a delay interval T. In response to the high voltage output from the comparator 20, the monostable 32 is triggered after the delay interval introduced by the delay circuit 26 to produce a sampling pulse 32-1 for application to the AND gates 36, 38. Since the potential at the noninverting input of the comparator 28 is higher than the threshold $V_L$ during the time prior to time $t_2$, the comparator 28 remains in the high output state until that time and then switches to a low output state in response to the gas sensor output reducing to a level below $V_L$. The gas sensor output then adopts the curve Y' during the interval the injection current is inhibited until time $t_3$ at which the monostable 24 output terminates and returns to the curve Y. Simultaneously, the comparator 28 output returns to the high voltage level.

The low voltage output from the comparator 28 is sampled by AND gate 36 in response to the sampling pulse 32-1 and triggers the flip-flop 40 into a set condition producing therefrom a signal indicating that the gas sensor 10 is in a lean condition. This signal is applied to the control terminal of a switch 44 which is provided with a home position H and lean and rich positions L and R. In the absence of a control signal, the switch 44 is in the position H to couple the threshold voltage $V_H$ from terminal 22 to the noninverting input of an integral operational amplifier 48 and activated in response to the lean condition signal from flip-flop 40 to switch to the lean position L to connect a higher threshold voltage $V_{HH}$, whereby the output of the integrator 48 and hence the potential at the noninverting input of the comparator 14 is raised from $V_H$ to $V_{HH}$ as indicated by broken lines 50 in FIG. 3. The integrator 48 includes a resistor 52 and a capacitor 54 which are connected in the known integrator circuit configuration with the operational amplifier and is arranged to receive a positive polarity input voltage B+ of a suitable value from a terminal 56 via switch 58 and resistor 52 at the inverting input thereof. The output from the delay circuit 26 is also coupled to switches 60 and 15 to enable them to pass the output of comparator 14 to the control gate of switch 58 and to a proportional/integral controller 17, respectively. The controller 17 modifies the output of the comparator 14 in accordance with predetermined control characteristics and supplies its output signal to an air-fuel correction means 68 such as electronic carburetor or fuel injection circuit in order to correct the mixture ratio in accordance with the deviation of the gas sensor output from the variable reference voltage applied to the comparator 14. The fuel control system of the invention is thus switched from the initial open loop mode to a closed control mode at time $t_2'$ in response to the closure of switch 15. As a result, the gas sensor output begins to fluctuate between chain-dot curves X and Y as indicated in FIG. 3. More specifically, the comparator 14, which is initially at low output state, switches to a high voltage output state at time $t_1$ when the gas sensor output falls below the reference level $V_H$. Thus the high voltage signal from the comparator 14 is coupled through switch 60 to the control terminal of switch 58 to apply the positive potential to the inverting input of the integrator 48 through resistor 52 to permit it to allow integration of the input voltage in the negative direction with respect to the polarity of the potential at the noninverting input thereof, resulting in a gradual reduction of the reference voltage at the noninverting input of the comparator 14 as shown in FIG. 3 until the comparator 14 switches to a low voltage state in response to the gas sensor output becoming higher than the reference potential supplied from the integrator 48 at time $t_4$. Thus, during the subsequent period between times $t_4$ and $t_5$, the comparator 14 remains in the low voltage condition and the switch 58 is thus inhibited. The integrator 48 suspends integration during the time interval $t_4$ to $t_5$ and holds its output voltage constant.

It is thus appreciated that the reference potential for the comparator 14 is increased in response to the gas sensor output reducing to a level below the higher reference point $V_H$ and then decreased in step with the change in output state of the comparator 14 if the initial condition of the gas sensor indicates a lean condition, and the reference voltage adopts a curve which lies between curves X and Y.

A clamping circuit 66 is connected between terminal 30 and the noninverting input of comparator 14 to clamp the variable reference potential at the level of the low threshold $V_L$ after the output of integrator 48 reaches $V_L$.

During the closed loop operation, the comparator 14 is fed with the constant reference voltage $V_L$ with which the gas sensor output is compared to develop a signal representative of the deviation of air-fuel ratio from the reference point. The catalytic converter 13 is exposed thus to the controlled exhaust gases and operates at maximum efficiency to convert the hamful emissions into harmless products.

Figure 4:
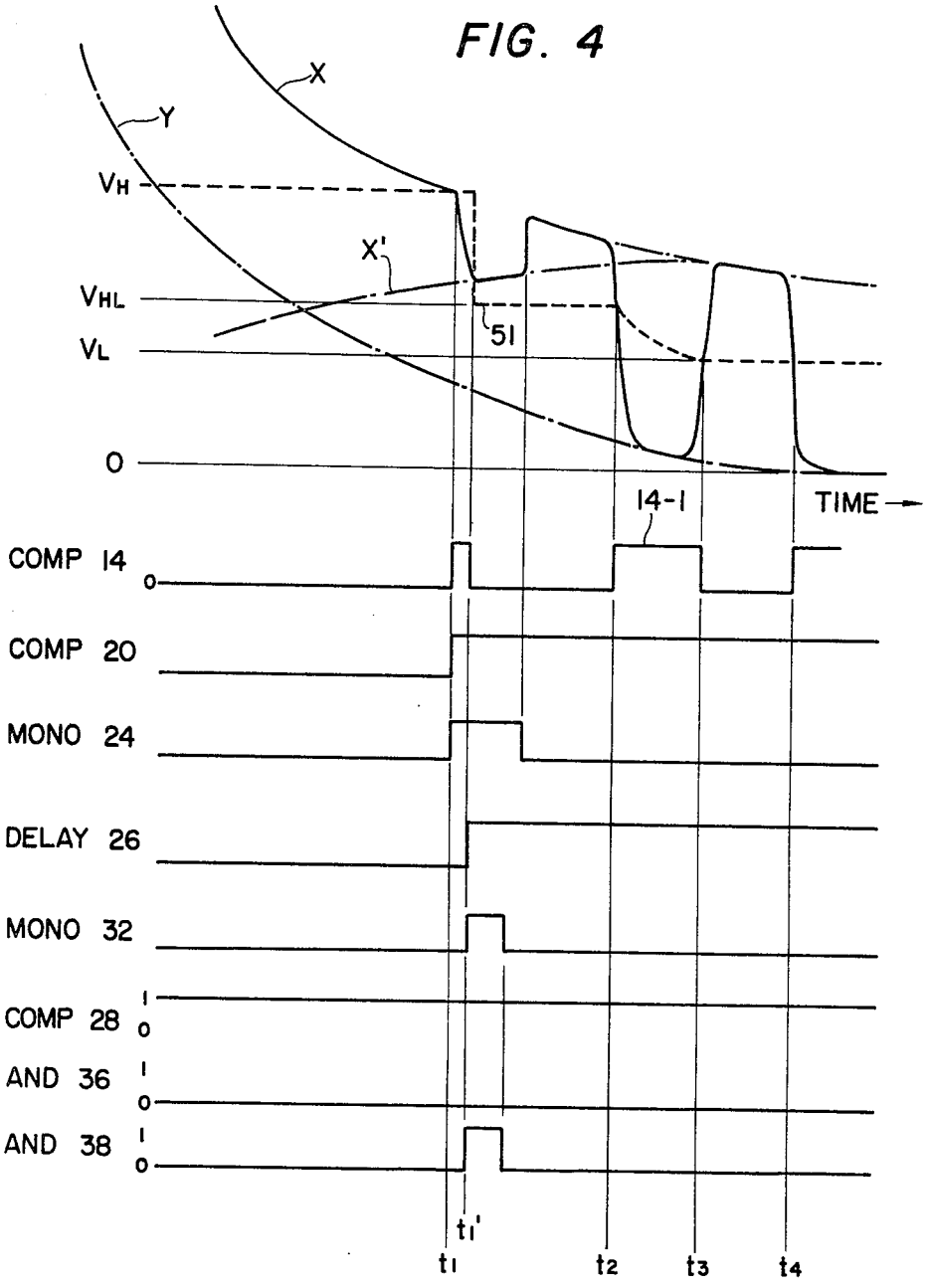
FIG. 4 is a waveform diagram useful for describing the operation of the embodiment when the gas sensor's initial condition represents a rich mixture.

Conversely, if the gas sensor is initially indicative of a rich condition, the output voltage therefrom adopts the curve X as shown in FIG. 4 which decreases with time to a point where it crosses the high threshold $V_H$. This is detected by the comparator 20 producing a high voltage signal which triggers the monostable 24 and delay circuit 26, the latter subsequently triggering the monostable 32 in the same manner as described in connection with FIG. 3. The gas sensor output on curve X thus rapidly drops to the corresponding point on curve X'. Since the level of the reduced gas sensor output is still higher than the threshold $V_L$, the comparator 28 remains in the high output state which is sampled in response to the monostable 32 output to activate AND 38 triggering a flip-flop 42 into the set condition to indicate that the initial condition of the gas sensor 10 represents enriched mixture. The switch 44 is activated to couple a lower threshold voltage $V_{HL}$, so that the noninverting input of the comparator 14 is lowered from $V_H$ to $V_{HL}$ as indicated by broken lines 51 in FIG. 4. Since the comparator 14 is switched to the low output state at time $t_1'$ in response to the threshold $V_H$ reducing to $V_{HL}$, the switch 58 is held open and the integrator 48 thus maintains its output constant until time $t_2$ when the gas sensor output falls below the lower threshold $V_{HL}$. During time interval between $t_2$ and $t_3$ the gas sensor output is reduced to the minimum voltage level on curve Y, permitting the comparator 14 to generate a high voltage output pulse 14-1. The pulse 14-1 is coupled via switch 60 to the control terminal of switch 58 to apply B+ potential to the inverting input of the integrator 48, so that the latter provides integration of the input voltage in the negative direction as mentioned previously, reducing the threshold potential at the noninverting input of the comparator 14. In a subsequent interval between times $t_3$ and $t_4$ the integrator 48 suspends integration and maintains its output voltage constant.

It will be understood from the foregoing that the reference point of the fuel control system of the invention is first raised or lowered by a predetermined amount depending on the initial condition of the gas sensor 10 and then decreased in step with variations in the gas sensor output voltage with respect to the reference point as the system commences closed loop operation until the reference value reaches $V_L$, whereupon the reference potential is held at this value by means of the clamping circuit 66. The variable reference point thus lies within the range between curves X and Y during the initial stage of the gas sensor operation and the system is switched to closed loop operational mode earlier than the prior art closed loop fuel control system, thereby reducing the amount of noxious emissions during engine warm-up periods.

What is claimed is:

1. A method for controlling the air-fuel ratio of mixture supplied to an internal combustion engine having air-fuel correcting means and an exhaust gas sensor for generating a signal representative of the concentration of an exhaust composition of the emission from said engine, said gas sensor having an internal impedance which varies inversely as a function of temperature, and means for generating a signal representative of the deviation of said concentration representative signal from a reference value, comprising the steps of:

(a) supplying a substantially constant current into said exhaust gas sensor to develop a corresponding voltage across said internal impedance;

(b) detecting when said voltage across said internal impedance reduces to a level below a first threshold level;

(c) applying said deviation representative signal to said air-fuel correcting means substantially in response to the step (b) to cause said mixture to be controlled in a closed loop mode;

(d) interrupting said current for a predetermined period of time in response to the step (b);

(e) generating a first or a second signal depending respectively on whether said concentration representative signal generated during said period of time is above or below a second threshold level lower than said first threshold level;

(f) varying said reference value in different directions in response to the presence of one of said first and second signals; and (g) decreasing said reference value in response to the step (f) as a function of temperature until said second threshold level is reached.

2. A method as claimed in claim 1, wherein said step (c) includes the step of introducing a delay interval in response to the step (b) prior to the application of said deviation representative signal to said air-fuel correcting means.

3. A method as claimed in claim 1, wherein the step (f) includes the step of increasing said reference value from said first threshold level to a higher threshold level in response to said second signal or decreasing said reference value from said first threshold level to a lower threshold level in response to said first signal.

4. A method as claimed in claim 3, wherein the step (f) includes the step of decreasing said reference value in step with variations of said deviation representative signal.

5. A mixture control system for an internal combustion engine having air-fuel correcting means and an exhaust gas sensor for generating a signal representative of the concentration of an exhaust composition of the emissions from said engine, said gas sensor having an internal impedance which varies inversely as a function of temperature, and means for generating a signal representative of the deviation of said concentration representative signal from a reference voltage for controlling said air-fuel correcting means, comprising:

means for supplying a substantially constant current into said exhaust gas sensor to develop a corresponding voltage across said internal impedance;

means for detecting when said voltage across said impedance reduces to a level below a first threshold level;

means responsive to said first detecting means for interrupting said supplied current for a predetermined period of time;

means responsive to said interrupting means for generating a first or a second signal depending on whether said concentration representative signal generated during said period of time is above or below a second threshold level lower than said first threshold level; and means for varying said reference voltage in different directions in response to the presence of one of said first and second signals and subsequently decreasing said reference voltage as a function of time.

6. A mixture control system as claimed in claim 5, wherein said first and second signal generating means comprises:

a comparator having a first input terminal connected to said exhaust gas sensor and a second input terminal connected to a source of voltage corresponding to said second threshold level to generate a comparator output signal;

means for introducing a delay in response to the output of said first detecting means; and means for sampling said comparator output signal in response to the output of said delaying means and holding the sampled comparator output signal, and wherein said reference voltage varying means is responsive to the output of said sampling and holding means to increase said reference voltage to a level higher than said first threshold level or decrease said reference voltage to a level lower than said first threshold level depending on the voltage level of said comparator output signal.

7. A mixture control system as claimed in claim 6, further comprising switching means responsive to said delay introducing means for applying said deviation representative signal to said air-fuel correcting means to cause said mixture control system to operate in a closed loop mode, whereby said deviation representative signal varies between high and low voltage levels with respect to said varying reference value.

8. A mixture control system as claimed in claim 7, wherein said reference voltage varying means comprises:

variable reference establishing means for generating a first voltage in the absence of said output from said sampling and holding means and one of second and third voltages in the presence of said output from said sampling and holding means depending on the voltage level of said comparator output signal;

an operational amplifier having a first input terminal receptive of said first, second and third voltages and a second input terminal connected to the output terminal thereof through a capacitor; and switching means for applying a constant voltage to the second input terminal of said operational amplifier through a resistor in response to variations in said deviation representative signal to permit said operational amplifier to integrate said constant voltage as a function of time in a reverse direction with respect to the polarity of the voltage applied to said first input terminal to decrease the output voltage of said operational amplifier in step with said deviation representative signal.

* * * * *